US008837993B2

(12) United States Patent
Yamazaki

(10) Patent No.: US 8,837,993 B2
(45) Date of Patent: Sep. 16, 2014

(54) DEVELOPING DEVICE CAPABLE OF PRECISELY POSITIONING THICKNESS-REGULATING MEMBER

(75) Inventor: Ryuya Yamazaki, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 32 days.

(21) Appl. No.: 13/598,930

(22) Filed: Aug. 30, 2012

(65) Prior Publication Data

US 2013/0058684 A1 Mar. 7, 2013

(30) Foreign Application Priority Data

Aug. 31, 2011 (JP) ..... 2011-190044

(51) Int. Cl.
*G03G 15/08* (2006.01)

(52) U.S. Cl.
CPC .... *G03G 15/0896* (2013.01); *G03G 2215/0141* (2013.01); *G03G 15/0812* (2013.01)
USPC ..... 399/284; 399/262; 399/111

(58) Field of Classification Search
CPC ..... G03G 15/0812
USPC ..... 399/284, 111, 262
See application file for complete search history.

(56) References Cited

U.S. PATENT DOCUMENTS

| | | | | |
|---|---|---|---|---|
| 2007/0036581 | A1 | 2/2007 | Okabe | |
| 2009/0180816 | A1 * | 7/2009 | Sato et al. | 399/260 |
| 2011/0158687 | A1 | 6/2011 | Mori | |
| 2011/0158710 | A1 * | 6/2011 | Shiraki et al. | 399/284 |

FOREIGN PATENT DOCUMENTS

| | | | |
|---|---|---|---|
| JP | 08-220880 | A | 8/1996 |
| JP | 2009-168993 | A | 7/2009 |

OTHER PUBLICATIONS

CN Notification of the First Office Action mailed Mar. 5, 2014, CN Appln. 201210324555.2, English translation.

* cited by examiner

*Primary Examiner* — G. M. Hyder
(74) *Attorney, Agent, or Firm* — Banner & Witcoff, Ltd.

(57) ABSTRACT

A developing device includes: a first frame; a second frame; a developer-carrying member; and a thickness-regulating member. The first frame includes: a pair of first walls opposed with each other; and a second wall connecting the pair of first walls and having a first fixing part. The second frame includes a third wall opposed to the second wall and attached to the pair of first walls when assembled to the first frame. The developer-carrying member has an axis extending in a first direction, is configured to rotate about the axis, and is disposed between the pair of first walls. The thickness-regulating member is fixed to the first fixing part and is configured to regulate a thickness of developer carried on the developer-carrying member. The third wall is disposed between the second wall and the thickness-regulating member.

19 Claims, 6 Drawing Sheets

DEVELOPING DEVICE CAPABLE OF PRECISELY POSITIONING THICKNESS-REGULATING MEMBER

CROSS REFERENCE TO RELATED APPLICATION

This application claims priority from Japanese Patent Application No. 2011-190044 filed Aug. 31, 2011. The entire content of this application is incorporated herein by reference.

TECHNICAL FIELD

The present invention relates to an image-forming device employing an electrophotographic system, and a developing device that is detachably mountable in the image-forming device.

BACKGROUND

An electrophotographic printer known in the art has developing devices detachably mounted therein. Each developing device includes a developing frame, a developing roller supported in the developing frame for carrying toner, and a blade assembly for restricting the thickness of the toner layer carried on the developing roller.

One such developing device that has been proposed is a developer cartridge in which the developing frame is configured of a lower frame for rotatably supporting the developing roller, and an upper frame welded to the lower frame.

In this developer cartridge, an opening exposing the developing roller is defined by the front end of a beam-like part constituting the upper frame, and the front ends of the two side walls and the bottom wall of the lower frame. The blade assembly is fixed to both the upper frame and the lower frame. Specifically, the blade assembly is fixed to screw-mounting holes adjacent to the front end of the beam-like part constituting the upper frame and to the upper front end of both side walls constituting the lower frame.

SUMMARY

However, while the developing roller is supported in the lower frame of the developer cartridge described above, the blade assembly is fixed to both the upper and lower frames. Consequently, offset between the upper and lower frames occurring during the welding process or variation in the frames themselves may inhibit sufficient relative positioning precision between the blade assembly and the developing roller.

Further, since the blade assembly is fixed to the screw-mounting holes adjacent to the front end of the beam-like part constituting the upper frame and the upper front end of both side walls constituting the lower frame, in some cases the opening defined by the beam-like part and side walls is too wide to ensure sufficient strength in the developing frame. Insufficient strength in the developing frame may make it impossible to maintain the relative positional relationship of the blade assembly and developing roller.

Therefore, it is an object of the present invention to provide a developing device, and an image-forming device provided with the developing device, that can improve the strength of the assembled first and second frames through a simple structure and that can improve precision in positioning the developer-carrying member and thickness-regulating member relative to each another.

In order to attain the above and other objects, the invention provides a developing device including: a first frame; a second frame; a developer-carrying member; and a thickness-regulating member. The first frame includes: a pair of first walls opposed with each other; and a second wall connecting the pair of first walls and having a first fixing part. The second frame includes a third wall opposed to the second wall and attached to the pair of first walls when assembled to the first frame. The developer-carrying member has an axis extending in a first direction, is configured to rotate about the axis, and is disposed between the pair of first walls. The thickness-regulating member is fixed to the first fixing part and is configured to regulate a thickness of developer carried on the developer-carrying member. The third wall is disposed between the second wall and the thickness-regulating member.

Another aspect of the present invention provides an image-forming device including: a main body; and a developing device mountable of the main body. The developing device includes: a first frame; a second frame; a developer-carrying member; and a thickness-regulating member. The first frame includes: a pair of first walls opposed with each other; and a second wall connecting the pair of first walls and having a first fixing part. The second frame includes a third wall opposed to the second wall and attached to the pair of first walls when assembled to the first frame. The developer-carrying member has an axis extending in a first direction, is configured to rotate about the axis, and is disposed between the pair of first walls. The thickness-regulating member is fixed to the first fixing part and is configured to regulate a thickness of developer carried on the developer-carrying member. The third wall is disposed between the second wall and the thickness-regulating member.

Another aspect to the present invention provides a developing device includes: a first frame; a second frame; a developer-carrying member; and a thickness-regulating member. The first frame includes: a pair of first walls opposed with each other; and a second wall connecting the pair of first walls and having a first fixing part. The second frame includes a third wall opposed to the second wall and attached to the pair of first walls when assembled to the first frame. The developer-carrying member has an axis extending in a first direction, is configured to rotate about the axis, and is disposed between the pair of first walls. The thickness-regulating member is fixed to the first fixing part and is configured to regulate a thickness of developer carried on the developer-carrying member.

BRIEF DESCRIPTION OF THE DRAWINGS

The particular features and advantages of the invention as well as other objects will become apparent from the following description taken in connection with the accompanying drawings, in which.

DETAILED DESCRIPTION

1. Printer

Figure 1:
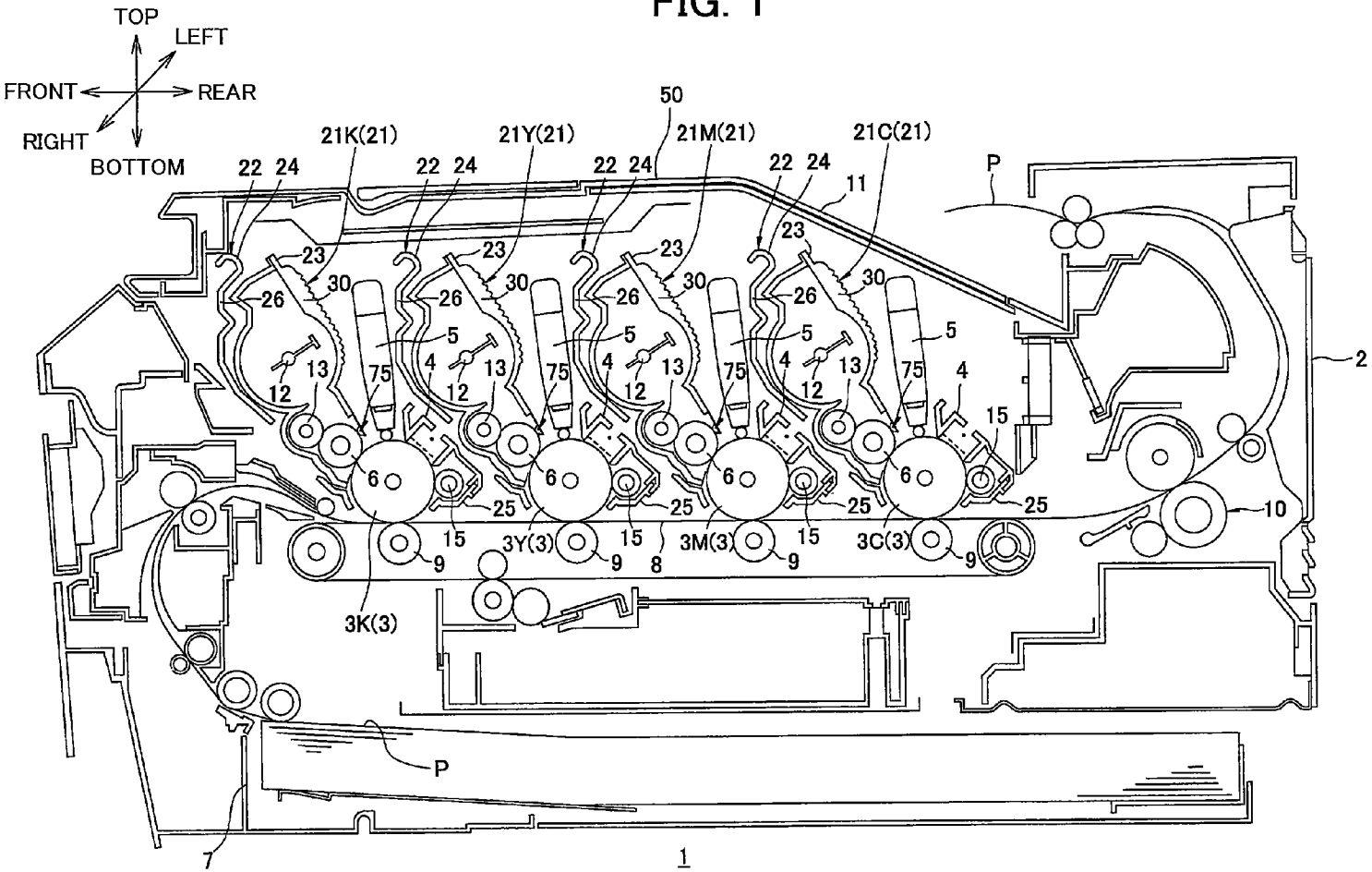
FIG. 1 is a lateral cross-sectional view of a printer according to an embodiment of the present invention.

As shown in FIG. 1, a printer 1 (one example of the image-forming device of the present invention) is a direct tandem-type color printer.

In the following description, directions related to the printer 1 and developer cartridges 23 (described later) will correspond to the directions of the arrows indicated in the drawings and will assume that the printer 1 is in a level orientation and that the developer cartridges 23 are vertically erect. In addition, the left-right direction will be equivalent to the width direction.

Specifically, the vertical and front-rear directions of the printer 1 and drum cartridges 22 (described later) differ from the vertical and front-rear directions of the developer cartridges 23. The developer cartridges 23 are mounted in the printer 1 and drum cartridges 22 so that their front side faces the upper front side of the printer 1 and their rear side faces the bottom rear side of the printer 1.

The printer 1 includes a main casing 2 (one example of the main body of the present invention). Four photosensitive drums 3 are arranged inside the main casing 2 parallel to each other and juxtaposed in the front-rear direction. In the following description, the four photosensitive drums 3 are differentiated according to the colors (black, yellow, magenta, and cyan) of toner images they carry and, thus will be referred to as a black photosensitive drum 3K, a yellow photosensitive drum 3Y, a magenta photosensitive drum 3M, and a cyan photosensitive drum 3C.

Disposed in opposition to each photosensitive drum 3 are a Scorotron charger 4, an LED unit 5, and a developing roller 6 (one example of the developer-carrying member of the present invention).

The surfaces of the photosensitive drums 3 are uniformly charged by the corresponding Scorotron chargers 4 and are subsequently exposed to light emitted by the corresponding LED units 5 based on image data, forming electrostatic latent images on the surfaces of the respective photosensitive drums 3. Toner carried on the developing rollers 6 is supplied to the corresponding latent images, producing visible toner images on the surfaces of the photosensitive drums 3.

Sheets P of a paper are accommodated in a paper cassette 7 inside the main casing 2. Various rollers are provided for supplying the sheets P from the paper cassette 7 to a conveying belt 8. A portion of the conveying belt 8 is disposed between the photosensitive drums 3, and transfer rollers 9 disposed at positions confronting the respective photosensitive drums 3. A transfer bias is applied to the transfer roller 9 for sequentially transferring the toner images carried on the photosensitive drums 3 onto the sheet P so that the images are superimposed.

After toner images in the four colors have been transferred onto the sheet P, the sheet P is conveyed to a fixing unit 10. The fixing unit 10 fixes the toner images to the sheet P with heat. Various rollers are provided for subsequently discharging the sheet P into a discharge tray 11.

2. Process Cartridges

The printer 1 is provided with four process cartridges 21 corresponding to the four printing colors. The four process cartridges 21 are distinguished in the following description according to their corresponding color, i.e., a black process cartridge 21K, a yellow process cartridge 21Y, a magenta process cartridge 21M, and a cyan process cartridge 21C.

The process cartridges 21 are detachably mounted in the main casing 2 and are arranged parallel to one another and juxtaposed in the front-rear direction.

A top cover 50 is provided in the top wall of the main casing 2 and can be opened and closed. The process cartridges 21 can be mounted in or removed from the main casing 2 by opening the top cover 50.

Each process cartridge 21 includes a drum cartridge 22 detachably mounted in the main casing 2, and a developer cartridge 23 (one example of the developing device of the present invention) detachably mounted in the drum cartridge 22.

(1) Drum Cartridges

The drum cartridge 22 is configured of a drum frame 24. The drum frame 24 further includes a drum support part 25, and a developer-cartridge-accommodating part 26.

The drum support part 25 constitutes the lower side of the drum frame 24 and functions to support the corresponding photosensitive drum 3, Scorotron charger 4, and a drum cleaning roller 15.

The photosensitive drums 3 are substantially cylindrical in shape and elongated in the left-right direction. The photosensitive drums 3 are rotatably supported in bottom ends of the respective drum support parts 25 and exposed through openings formed in the bottoms of the same. The Scorotron chargers 4 are disposed so as to confront the corresponding photosensitive drums 3 from a position diagonally above and rearward therefrom, but are separated from the same. The drum cleaning rollers 15 are disposed on the rear side of their corresponding photosensitive drums 3, confronting and contacting the same.

The developer-cartridge-accommodating part 26 of each drum frame 24 is provided above and forward from the drum support part 25 and is formed with an opening on the top and rear sides to allow mounting and removal of the corresponding developer cartridge 23.

(2) Developer Cartridges

Figure 2:
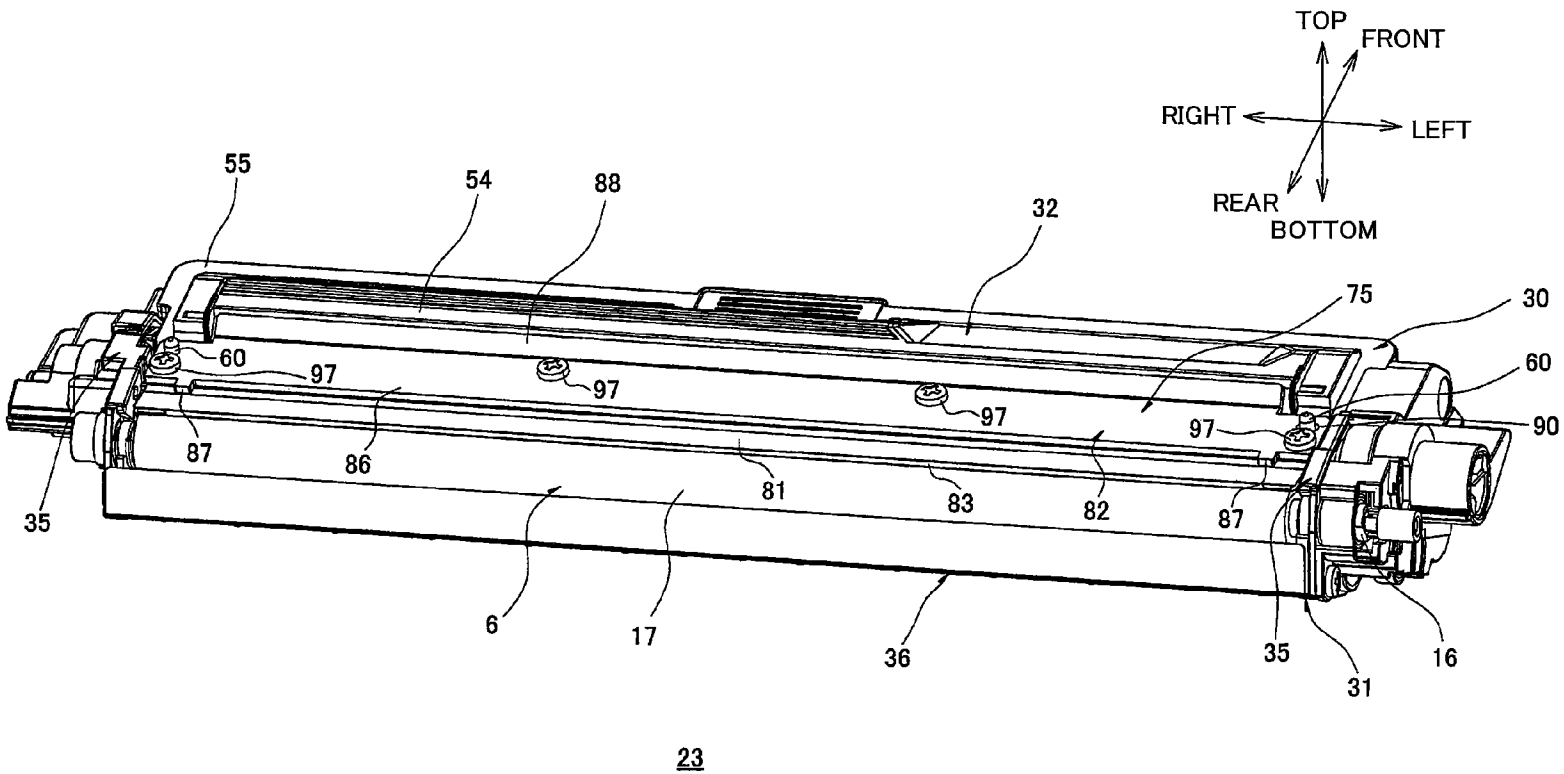
FIG. 2 is a perspective view of a developer cartridge according to the embodiment of the present invention when viewed from a left-top side.
Figure 3:
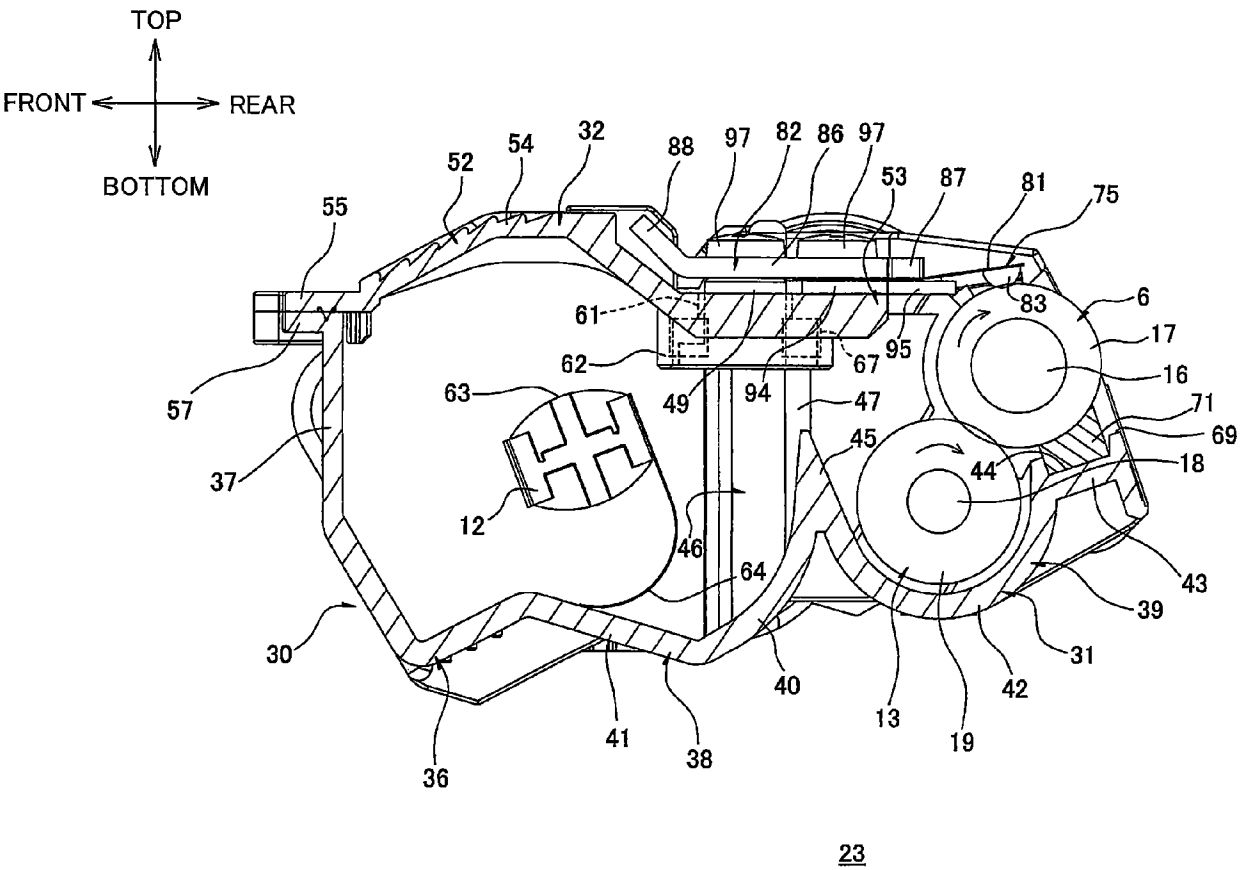
FIG. 3 is a lateral cross-sectional view of the developer cartridge shown in FIG. 2.

As shown in FIGS. 2 and 3, each of the developer cartridges 23 is configured of a developer frame 30. The developer frame 30 is generally box-shaped and elongated in the left-right direction. The developer frame 30 includes a lower frame 31 (one example of the first frame of the present invention), and an upper frame 32 (one example of the second frame of the present invention).

(2-1) Lower Frame

Figure 4:
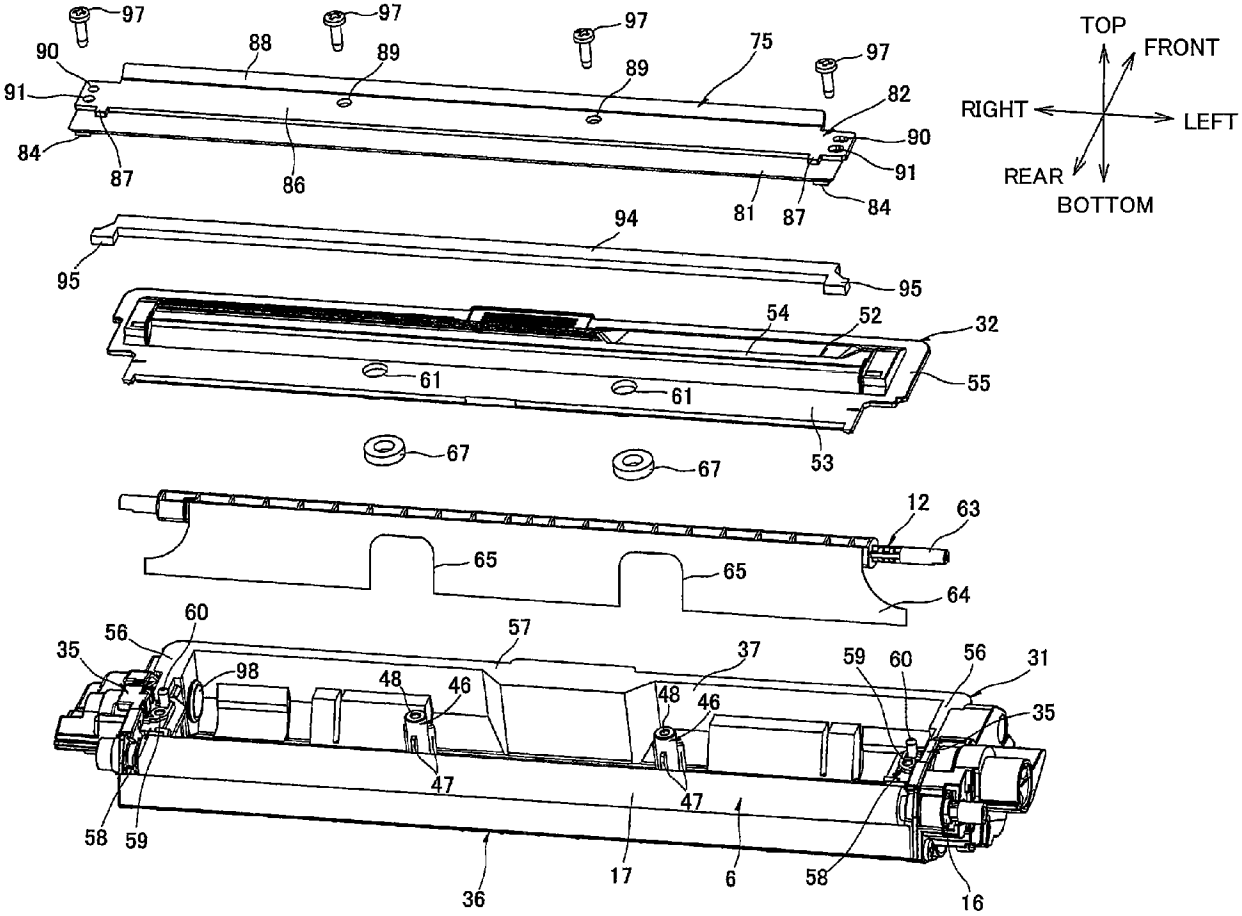
FIG. 4 is a perspective view of the disassembled developer cartridge shown in FIG. 2.

As shown in FIG. 4, the lower frame 31 is integrally configured of a pair of side walls 35 (one example of the pair of first walls of the present invention) arranged parallel to each other and separated in the width direction, a bottom wall 36 (one example of the second wall of the present invention) connecting the lower edges of the side walls 35, and a front wall 37 connecting the front edges of the side walls 35 and bottom wall 36.

The side walls 35 have a generally flat plate shape. First contact parts 56 are formed on the top edge of the side walls 35, and second fixing parts 58 are formed on the rear portion of the side walls 35.

Each of the first contact parts 56 has a generally flat plate shape. The first contact parts 56 extend continuously outward from the top edges of the side walls 35 in left and right directions, respectively.

The second fixing parts 58 have a generally flat plate shape and extend continuously inward from the top edges of the side walls 35 in left and right directions, respectively.

A second screw hole 59 is formed in each second fixing part 58. A positioning protrusion 60 is formed on each second fixing part 58. The second screw holes 59 penetrate the centers of the corresponding second fixing parts 58 vertically. The positioning protrusions 60 are provided on the second fixing parts 58 in front of the corresponding second screw holes 59. The positioning protrusions 60 protrude upward from the respective second fixing parts 58. The distal end of each positioning protrusion 60 is generally arc-shaped in cross section, with the convex side of the arc facing upward.

A toner fill hole 98 is formed in the right side wall 35. The toner fill hole 98 is generally circular in shape in a side view and is formed in a front side portion of the right side wall 35 corresponding to a toner-accommodating chamber 38 (described later).

As shown in FIG. 3, the front portion of the bottom wall 36 is formed continuously of a curved wall 40, and a bent wall 41, while the rear portion of the bottom wall 36 is formed continuously of an arc-shaped wall 42, and a rib part 43.

The curved wall 40 has a general arc shape that follows the rotational path of an agitator 12 (described later).

The bent wall 41 has an upward bend formed at a midpoint in the front-rear direction. More specifically, beginning from its rear edge, the bent wall 41 slopes upward toward the front from the front edge of the curved wall 40 and subsequently bends so as to slope downward toward the front.

The arc-shaped wall 42 has a general arc shape that follows the rotational path of a supply roller 13 (described later).

The rib part 43 has a general T-shape in a side view, with the bottom of the "T" formed continuously with the rear edge of the arc-shaped wall 42 and the head of the "T" protruding rearward. A lower-sponge-holding part 44 is formed on the top surface of the rib part 43. The lower-sponge-holding part 44 has a generally squared U-shape in a side view that opens upward.

The front portion and rear portion of the bottom wall 36 are formed continuously by coupling the rear edge of the curved wall 40 with the front edge of the arc-shaped wall 42.

A partitioning wall 45 is formed between the front portion and rear portion of the bottom wall 36. The partitioning wall 45 is formed as a continuous extension from the curved wall 40 and arc-shaped wall 42, protruding upward. That is, the partitioning wall 45 protrudes toward the upper frame 32 while extending in the left-right direction.

The distal end of the partitioning wall 45 vertically confronts but is separated from the bottom surface of a rear-side top wall 53 (described later) of the upper frame 32.

As shown in FIG. 4, a plurality (two in the preferred embodiment) of first fixing parts 46 is formed in the bottom wall 36 adjacent to the front side of the partitioning wall 45. Hence, the first fixing parts 46 are disposed inside the toner-accommodating chamber 38 (described later). Each first fixing part 46 is generally cylindrical in shape and is erected upward from the curved wall 40 (see FIG. 3). The distal ends of the first fixing parts 46 penetrate corresponding cylindrical parts 62 and through-holes 61 (described later) so as to protrude upward from the rear-side top wall 53 (described later). The portions of the first fixing parts 46 protruding above the rear-side top wall 53 will be referred to as protruding portions 49 (see FIG. 3). First screw holes 48 are formed in the top ends of the protruding portions 49.

The vertical dimension of the protruding portions 49 is substantially equivalent to the sum of thicknesses of a sealing member 94 and a blade member 81 (described later; see FIG. 3).

Ridge parts 47 are provided on the outer peripheral surface of each first fixing part 46. The ridge parts 47 are generally rectangular in a plan view and protrude radially from the peripheral surface of the first fixing part 46 in directions orthogonal to the vertical. The ridge parts 47 extend vertically from the base end of the first fixing part 46 to a vertical midpoint, with the upper end faces confronting the bottom surface of the rear-side top wall 53 (described later).

A plurality (three in the preferred embodiment) of the ridge parts 47 is provided on each first fixing part 46. The ridge parts 47 are formed on the outer peripheral surface of the first fixing part 46 at regular intervals in the circumferential direction so as to be separated from each other by about 120 degrees.

Figure 5:
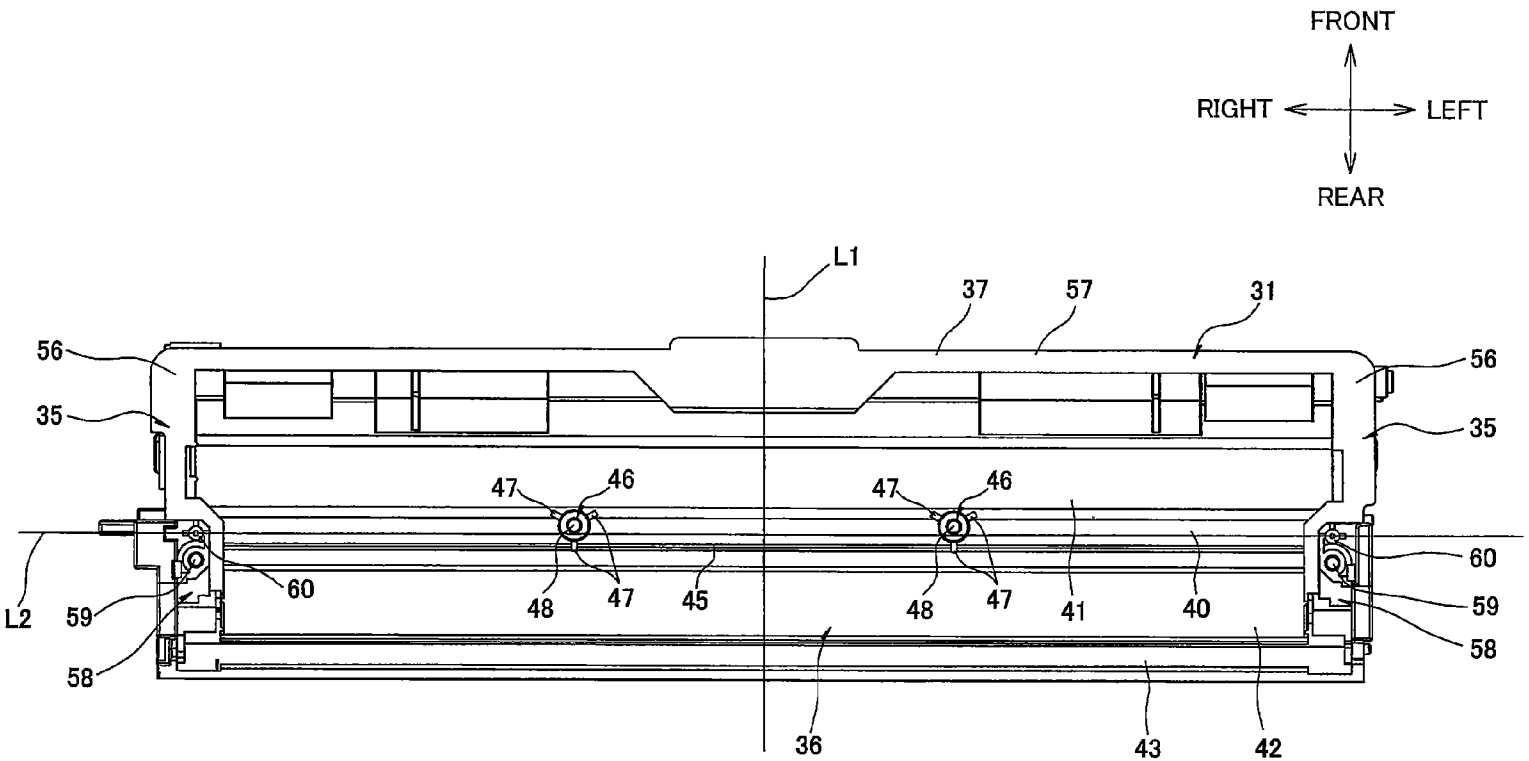
FIG. 5 is a plane view of a lower frame shown in FIG. 4.

As shown in FIG. 5, the first fixing parts 46 are symmetrical about a line L1 extending in the front-rear direction (a plane orthogonal to the left-right direction) and passing through the left-to-right center of the lower frame 31. Further, the first fixing parts 46 and the positioning protrusions 60 are all arranged along a line L2 extending in the left-right direction.

As shown in FIG. 3, the bottom portion of the front wall 37 is formed continuously from the front edge of the bent wall 41, sloping upward toward the front, while the upper portion of the front wall 37 extends straight upward continuously from the top edge of the lower portion.

A second contact part 57 is formed on the top edge of the front wall 37. As shown in FIG. 4, the second contact part 57 has a generally flat plate shape that extends continuously forward from the top edge of the front wall 37.

(2-2) Upper Frame

The upper frame 32 is integrally provided with a front-side top wall 52, and a rear-side top wall 53 (one example of the third wall of the present invention).

The front-side top wall 52 is configured of an expanded part 54 and a contact part 55.

The expanded part 54 constitutes the central portion of the front-side top wall 52 and expands upward.

The contact part 55 has a substantially flat plate shape and is provided along both left and right sides and the front side of the expanded part 54 so as to surround the same. When the upper frame 32 is assembled to the lower frame 31, the contact part 55 conforms to the shape of the first contact parts 56 and the second contact part 57.

The rear-side top wall 53 has a generally flat plate shape and extends continuously rearward from the rear edge of the front-side top wall 52. The rear-side top wall 53 is positioned between the upper edges of the side walls 35 and opposes the bottom wall 36 vertically while remaining separated from the same (see FIG. 3).

A notch is formed in each of the left and right ends of the rear-side top wall 53. The notches are generally rectangular in a plan view and shaped to expose the second fixing parts 58 when the upper frame 32 is assembled to the lower frame 31.

A plurality (two in the preferred embodiment) of through-holes 61 is formed in the rear-side top wall 53. As shown in FIG. 3, the through-holes 61 are formed to allow insertion of the protruding portions 49 provided on the first fixing parts 46 when the upper frame 32 is assembled to the lower frame 31. The through-holes 61 have an inner diameter that is larger than the outer diameter of the first fixing parts 46.

As shown in FIG. 3, cylindrical parts 62 are provided on the bottom surface of the rear-side top wall 53. The cylindrical parts 62 have a general cylindrical shape and are positioned with their axes aligned with the centers of the corresponding through-holes 61. The through-holes 61 are inserted into the interior space of the cylindrical parts 62. The inner diameter of the cylindrical parts 62 is larger than the diameter of the through-holes 61.

An elastic member 67 is provided between the bottom surface of the rear-side top wall 53 inside each of the cylindrical parts 62 (around the outer edge of each through-hole 61) and the top edge of the corresponding ridge parts 47. The ridge parts 47 support the upper frame 32 via the elastic members 67. The elastic members 67 have a general annular shape. The inner diameter of each elastic member 67 is substantially equivalent to the outer diameter of the first fixing part 46, while the outer diameter of the elastic member 67 is substantially equivalent to the inner diameter of the cylindrical part 62.

(2-3) Developer Frame

As shown in FIG. 3, when the lower frame 31 and upper frame 32 are assembled together, as will be described later, a space formed in the developer frame 30 is divided by the partitioning wall 45 into the toner-accommodating chamber 38 (one example of the developer-accommodating chamber) constituting the space forward of the partitioning wall 45, and a developing chamber 39 constituting the space rearward of the partitioning wall 45. In other words, the partitioning wall 45 partitions the developer frame 30 into the toner-accommodating chamber 38 and developing chamber 39.

(2-4) Toner-Accommodating Chamber

The toner-accommodating chamber 38 is specifically defined by the side walls 35, partitioning wall 45, curved wall 40, bent wall 41, front wall 37, front-side top wall 52, and front portion of the rear-side top wall 53. The toner-accommodating chamber 38 is filled with toner (one example of the developer). An agitator 12 is also provided in the toner-accommodating chamber 38 and positioned in the vertical and front-to-rear center thereof.

As shown in FIG. 4, the agitator 12 includes a rotational shaft 63 that is rotatably supported in the side walls 35, and an agitating blade 64 provided on the rotational shaft 63.

The agitating blade 64 is fixed to the outer peripheral surface of the rotational shaft 63 and extends radially outward therefrom. A plurality (two in the preferred embodiment) of notched parts 65 is formed in the agitating blade 64 in areas corresponding to the first fixing parts 46 to avoid a contact with the first fixing parts 46. The notched parts 65 are generally U-shaped and open radially outward away from the rotational shaft 63.

By supporting the rotational shaft 63 in the side walls 35, the agitator 12 is rotatably supported in the developer frame 30.

(2-5) Developing Chamber

As shown in FIG. 3, the developing chamber 39 is specifically defined by the side walls 35, partitioning wall 45, arc-shaped wall 42, rib part 43, and rear portion of the rear-side top wall 53. An opening 69 is formed in the rear side of the developing chamber 39. The opening 69 is specifically defined by the rear edges of the side walls 35, the rear edge of the rib part 43, and the rear edge of the rear-side top wall 53.

The developing roller 6 and a supply roller 13 are provided inside the developing chamber 39.

The developing roller 6 is disposed in the rear end of the developing chamber 39 between the side walls 35 so that the rear and top portions of the developing roller 6 are exposed through the opening 69. The developing roller 6 is configured of a developing roller shaft 16, and a rubber roller 17 provided around the developing roller shaft 16. By rotatably supporting the developing roller shaft 16 in the side walls 35, the developing roller 6 is rotatably disposed in the developer frame 30.

During a developing operation, a drive force is transmitted to the developing roller 6 from a drive source (not shown), such as a motor, provided in the main casing 2. A power supply (not shown) also applies a developing bias to the developing roller 6 during the developing operation. When the drive force is transmitted from the drive source, the developing roller 6 is driven to rotate in a direction indicated by the arrow in FIG. 3 (clockwise in a right side view) so that a portion of the developing roller 6 confronting and contacting the supply roller 13 (described later in greater detail) moves in a direction opposite from the supply roller 13.

A lower sponge 71 is provided beneath the developing roller 6 so as to confront and contact the bottom surface of the same. The lower sponge 71 is generally rectangular in a side view and is retained in the lower-sponge-holding part 44.

The supply roller 13 is disposed inside the arc-shaped wall 42 so as to confront and contact the developing roller 6 on the lower front side. The supply roller 13 includes a supply roller shaft 18, and a sponge roller 19 provided around the supply roller shaft 18. By rotatably supporting the supply roller shaft 18 in the side walls 35, the supply roller 13 is rotatably provided in the developer frame 30.

During a developing operation, a drive force is transmitted to the supply roller 13 from a drive source (not shown), such as a motor, provided in the main casing 2. A power supply (not shown) also applies a supply bias to the supply roller 13 during a developing operation. When the drive force is transmitted from the drive source, the supply roller 13 is driven to rotate in a direction indicated by the arrow in FIG. 3 (clockwise in a right side view) so that the portion of the supply roller 13 confronting and contacting the developing roller 6 moves in a direction opposite from the developing roller 6.

(2-6) Thickness-Regulating Member

A thickness-regulating member 75 is provided on the developer frame 30 for regulating the layer thickness of toner carried on the surface of the developing roller 6. The thickness-regulating member 75 is disposed so as to confront the bottom wall 36 with the rear-side top wall 53 interposed therebetween. As shown in FIG. 4, the thickness-regulating member 75 includes a blade member 81 (one example of the first plate-like member of the present invention), and a reinforcing member 82 (one example of the second plate-like member of the present invention).

The blade member 81 is formed of a thin metal plate or the like having a degree of flexibility and has a generally flat plate shape that is elongated in the left-right direction. The front end of the blade member 81 is disposed on the rear-side top wall 53, and the rear end extends to a position above the developing roller 6 and opposes the outer peripheral surface of the same while remaining slightly separated therefrom. Provided on the rear end of the blade member 81 are a contact part 83 that contacts the surface of the 86, and side edge seals 84 that contact both ends of the developing roller 6.

The contact part 83 is formed of an elastic resin material, such as silicone resin. As shown in FIG. 3, the contact part 83 is disposed in a left-right orientation along the bottom surface of the blade member 81. The contact part 83 has a general arc shape in a side view, with the convex side facing downward.

As shown in FIG. 4, the side edge seals 84 are provided on the left and right edges of the blade member 81 so as to sandwich the contact part 83 in the left-right direction.

The reinforcing member 82 is integrally provided with a main body 86, protrusions 87 protruding from the rear edge of the main body 86, and an extension 88 extending obliquely upward and forward from the front edge of the main body 86.

The main body 86 has a generally flat plate shape and is elongated in the left-right direction. The front-rear dimension of the main body 86 is shorter than that of the blade member 81. First fixing holes 89 are formed in portions of the main body 86 corresponding to the through-holes 61. In addition, positioning holes 90 are formed one in each of the left and right ends of the main body 86 at positions corresponding to the positioning protrusions 60, while second fixing holes 91 are formed one on each of the left and right ends of the main body 86 at positions corresponding to the second screw holes 59. Hence, the second fixing hole 91 and the positioning hole 90 on each of the left and right ends of the main body 86 are aligned in the front-rear direction.

Two of the protrusions 87 are provided on the rear edge of the main body 86 at positions spaced apart in the left-right direction. The protrusions 87 are generally rectangular in a side view.

The extension 88 has a generally flat plate shape that is elongated in the left-right direction. The extension 88 is formed continuously with the front edge of the main body 86 at an angle bent obliquely upward and forward.

The blade member 81 and reinforcing member 82 are fixed together by bonding the upper surface on the front portion of the blade member 81 to the lower surface on the rear portion of the main body 86. Accordingly, the rear portion of the blade member 81 is exposed, i.e., not covered by the reinforcing member 82.

The blade member 81 is disposed so that its front portion is positioned between the positioning holes 90 and second fixing holes 91 formed in the main body 86. Note that through-holes (not shown) are formed in the front portion of the blade member 81 at positions corresponding to the second fixing holes 91.

A sealing member 94 is disposed between the thickness-regulating member 75 and the rear-side top wall 53 for sealing the gap between the same. The sealing member 94 is generally rectangular in a plan view and is elongated in the left-right direction. The sealing member 94 is disposed between the top surface of the rear-side top wall 53 and the bottom surface on the front portion of the blade member 81. In other words, the front portion of the blade member 81 and the sealing member 94 are sandwiched between the rear portion of the main body 86 and the rear-side top wall 53.

Side parts 95 are provided one on each left and right end of the sealing member 94. The side parts 95 are generally triangular in a plan view and protrude rearward and outward in respective left and right directions from the corresponding left and right ends of the sealing member 94.

(2-7) Assembling the Developer Cartridge

To assemble the developer cartridge 23, first the agitator 12 is assembled in the lower frame 31. The agitator 12 is arranged in the lower frame 31 so that the notched parts 65 are aligned with the first fixing parts 46. The agitator 12 is assembled to the lower frame 31 so that the rotational shaft 63 is rotatably supported in the side walls 35 at position corresponding to the toner-accommodating chamber 38 (see FIG. 3).

Next, the upper frame 32 is assembled to the lower frame 31. To assemble the upper frame 32 to the lower frame 31, first the elastic members 67 are fitted over the distal ends of the corresponding first fixing parts 46. Next, the distal ends of the first fixing parts 46 are inserted into the corresponding through-holes 61 formed in the upper frame 32, and the upper frame 32 is placed on top of the lower frame 31 so that the contact part 55, first contact parts 56, and second contact part 57 are aligned. At this time, the first fixing parts 46 fit loosely into the through-holes 61 since the outer diameter of the first fixing parts 46 is smaller than the diameter of the through-holes 61. Further, the elastic members 67 are positioned in the cylindrical parts 62 between the top ends of the corresponding ridge parts 47 and the bottom surface of the rear-side top wall 53.

Next, the assembled lower frame 31 and upper frame 32 are welded together. More specifically, the contact part 55, first contact parts 56, and second contact part 57 are welded to each other.

The developer frame 30 is formed by assembling the lower frame 31 and upper frame 32 as described above. Next, the supply roller 13 is assembled in the lower frame 31. Here, the supply roller 13 is assembled so that the left and right ends of the supply roller shaft 18 are rotatably supported in the side walls 35 at positions corresponding to the developing chamber 39, and the outer peripheral surface of the sponge roller 19 confronts the inner peripheral surface of the arc-shaped wall 42, with a slight gap formed therebetween (see FIG. 3).

Next, the developing roller 6 is assembled in the lower frame 31. The developing roller 6 is positioned so that the lower front side of the rubber roller 17 opposes and contacts the upper rear side of the sponge roller 19 and is assembled in the lower frame 31 so that the developing roller shaft 16 is rotatably supported in the side walls 35 at positions corresponding to the developing chamber 39 (see FIG. 3).

Next, the thickness-regulating member 75 is arranged on the upper frame 32. To arrange the thickness-regulating member 75 on the upper frame 32, first the thickness-regulating member 75 and sealing member 94 described above are prepared. Next, the sealing member 94 is arranged on the top surface of the rear-side top wall 53 constituting the upper frame 32.

Here, the sealing member 94 is placed over the rear edge of the rear-side top wall 53 and, excluding the side parts 95, is fixed to the rear-side top wall 53 with adhesive tape (not shown). The sealing member 94 is oriented so that the side parts 95 protrude rearward and outward in left and right directions from respective left and right ends of the rear-side top wall 53 and are positioned above the rear portion of the second fixing parts 58.

Next, the positioning protrusions 60 of the second fixing parts 58 are inserted through the corresponding positioning holes 90 formed in the reinforcing member 82, and the thickness-regulating member 75 is placed over the top of the rear-side top wall 53 so that the second screw holes 59 formed in the second fixing parts 58 are aligned with the corresponding second fixing holes 91. At this time, the first screw holes 48 of the first fixing parts 46 are visible in the corresponding first fixing holes 89 via the through-holes 61. The above operations complete the process of arranging the thickness-regulating member 75 on the upper frame 32.

Next, the thickness-regulating member 75 is fixed to the lower frame 31. To fix the thickness-regulating member 75 to the lower frame 31, four screw members 97 are inserted through each of the first fixing holes 89 and corresponding second fixing holes 91 and are screwed into the respective first screw holes 48 and second screw holes 59. This operation fixes the thickness-regulating member 75 to the lower frame 31, thereby completing assembly of the developer cartridge 23.

Thereafter, the toner-accommodating chamber 38 is filled with toner via the toner fill hole 98. Once the toner-accommodating chamber 38 is filled, a cap (not shown) is press-fitted into the toner fill hole 98 to seal the toner in the toner-accommodating chamber 38.

3. Operational Advantages (1) With the developer cartridge 23 of the preferred embodiment, the thickness-regulating member 75 is fixed to the first fixing parts 46 erected from the curved wall 40, as shown in FIG. 3. Hence, both the thickness-regulating member 75 and the developing roller 6 are positioned relative to the lower frame 31. Accordingly, this construction improves the precision for positioning the developing roller 6 and thickness-regulating member 75 relative to each other and, specifically, for positioning the developing roller 6 and contact part 83 relative to each other.

Further, since the distal ends of the first fixing parts 46 are inserted into the rear-side top wall 53, which forms the opening 69 together with the rear ends of the side walls 35 and bottom wall 36, the rear end of the rear-side top wall 53 defining the opening 69 is positioned farther rearward than the first fixing parts 46. This configuration can enhance the strength of the assembled lower frame 31 and upper frame 32 (the developer frame 30).

Hence, the developer cartridge 23 of the embodiment can enhance the strength of the developer frame 30 through a simple construction, while improving accuracy in positioning the developing roller 6 and thickness-regulating member 75 relative to each other.

(2) Further, the through-holes 61 are formed in the rear-side top wall 53 to allow the first fixing parts 46 to be inserted through and exposed above the rear-side top wall 53. Accordingly, when assembling the lower frame 31 and upper frame 32 together, i.e., when assembling the developer frame 30, the lower frame 31 and upper frame 32 need only be assembled together so that the distal ends of the first fixing parts 46 are exposed from the through-holes 61, making the assembly operation smooth and easy.

Further, since the first screw holes 48 formed in the distal ends of the first fixing parts 46 are exposed through the through-holes 61, the thickness-regulating member 75 can easily be fixed to the first fixing parts 46.

(3) The protruding portions 49 of the first fixing parts 46 are fitted in the through-holes 61 with play. Accordingly, in the event that a load is applied to the upper frame 32, this configuration can prevent the load from being applied to the first fixing parts 46, thereby preventing the load from being applied to the thickness-regulating member 75 fixed to the first fixing parts 46.

By preventing the contact part 83 of the thickness-regulating member 75 from pressing against the outer peripheral surface of the developing roller 6, this construction prevents a load applied to the upper frame 32 from deforming the developing roller 6.

(4) In the embodiment described above, the sealing member 94 is provided between the blade member 81 and the rear-side top wall 53 of the upper frame 32 to seal the gap between the blade member 81 and rear-side top wall 53. In addition, the vertical dimension of the protruding portions 49 is set substantially equivalent to the sum of thicknesses of the sealing member 94 and blade member 81. This configuration can prevent toner from leaking out through the blade member 81 and rear-side top wall 53.

(5) The second fixing parts 58 are formed in the top edge of the rear portion of the side walls 35. The thickness-regulating member 75 is fixed by screwing screw members 97 into the second screw holes 59 of the second fixing parts 58. By reliably fixing the thickness-regulating member 75 to the lower frame 31 in this way, it is possible to improve the precision for positioning the developing roller 6 and contact part 83 relative to each other.

(6) The positioning protrusions 60 are also formed on the corresponding second fixing parts 58. The positioning protrusions 60 are inserted through respective positioning holes 90 formed in the reinforcing member 82.

In addition, the positioning protrusions 60 are positioned along the same line L2, oriented in the left-right direction, as the first fixing parts 46. Accordingly, this arrangement can improve the precision for positioning the developing roller 6 and contact part 83 relative to each other.

(7) Each of the first fixing parts 46 has three ridge parts 47. The ridge parts 47 confront the bottom surface of the rear-side top wall 53 and support the upper frame 32 via the elastic members 67. Hence, if a load were applied to the upper frame 32, the elastic members 67 can mitigate the effects of this load, suppressing the degree of load applied to the lower frame 31. Accordingly, this configuration prevents the contact part 83 of the thickness-regulating member 75 from pressing against the developing roller 6, suppressing deformation of the developing roller 6.

(8) The thickness-regulating member 75 also includes the blade member 81 and reinforcing member 82. The front portion of the blade member 81 is disposed above the sealing member 94, while the reinforcing member 82 is arranged so that the front portion of the blade member 81 and the sealing member 94 are sandwiched between the reinforcing member 82 and the top surface of the rear-side top wall 53. The reinforcing member 82 is fixed to the first fixing parts 46 by screwing the screw members 97 into the first screw holes 48 via the first fixing holes 89, thereby fixing the blade member 81 relative to the lower frame 31.

In this way, the force for fixing the reinforcing member 82 to the first fixing parts 46 is not applied to the blade member 81, and the contact part 83 can suitably contact the outer peripheral surface of the developing roller 6 without deforming the same.

(9) In the preferred embodiment, the bottom wall 36 is provided with the partitioning wall 45. The partitioning wall 45 is adjacent to the first fixing parts 46 with respect to the front-rear direction. Accordingly, this configuration can enhance the strength of the lower frame 31.

(10) Further, since the first fixing parts 46 are arranged in the toner-accommodating chamber 38, additional space need not be provided for the first fixing parts 46, enabling the developer frame 30 and, hence, the developer cartridge 23 to be made compact.

(11) The agitator 12 is also provided in the toner-accommodating chamber 38. The agitating blade 64 of the agitator 12 has notched parts 65 formed therein at positions corresponding to the first fixing parts 46. Accordingly, the agitator 12 can be provided in the toner-accommodating chamber 38 while keeping the developer cartridge, 23 as compact as possible. Further, the notched parts 65 formed in the agitating blade 64 can ensure the smooth rotation of the agitating blade 64.

(12) Further, a plurality (two in the embodiment) of the first fixing parts 46 is provided and arranged symmetrically about the line L1 passing through the front-rear direction through the left-to-right center of the lower frame 31. Thus, the thickness-regulating member 75 can be fixed to the first fixing parts 46 with an even balance, helping to improve the precision for positioning the developing roller 6 and contact part 83 relative to each other.

(13) The printer 1 is also provided with the developer cartridges 23 described above. Hence, the configuration of the printer 1 can improve the precision for positioning the developing roller 6 and thickness-regulating member 75 (contact part 83) relative to each other.

4. Variations of the Embodiment

While the invention has been described in detail with reference to the embodiment thereof, it would be apparent to those skilled in the art that various changes and modifications may be made therein without departing from the spirit of the invention.

Figure 6:
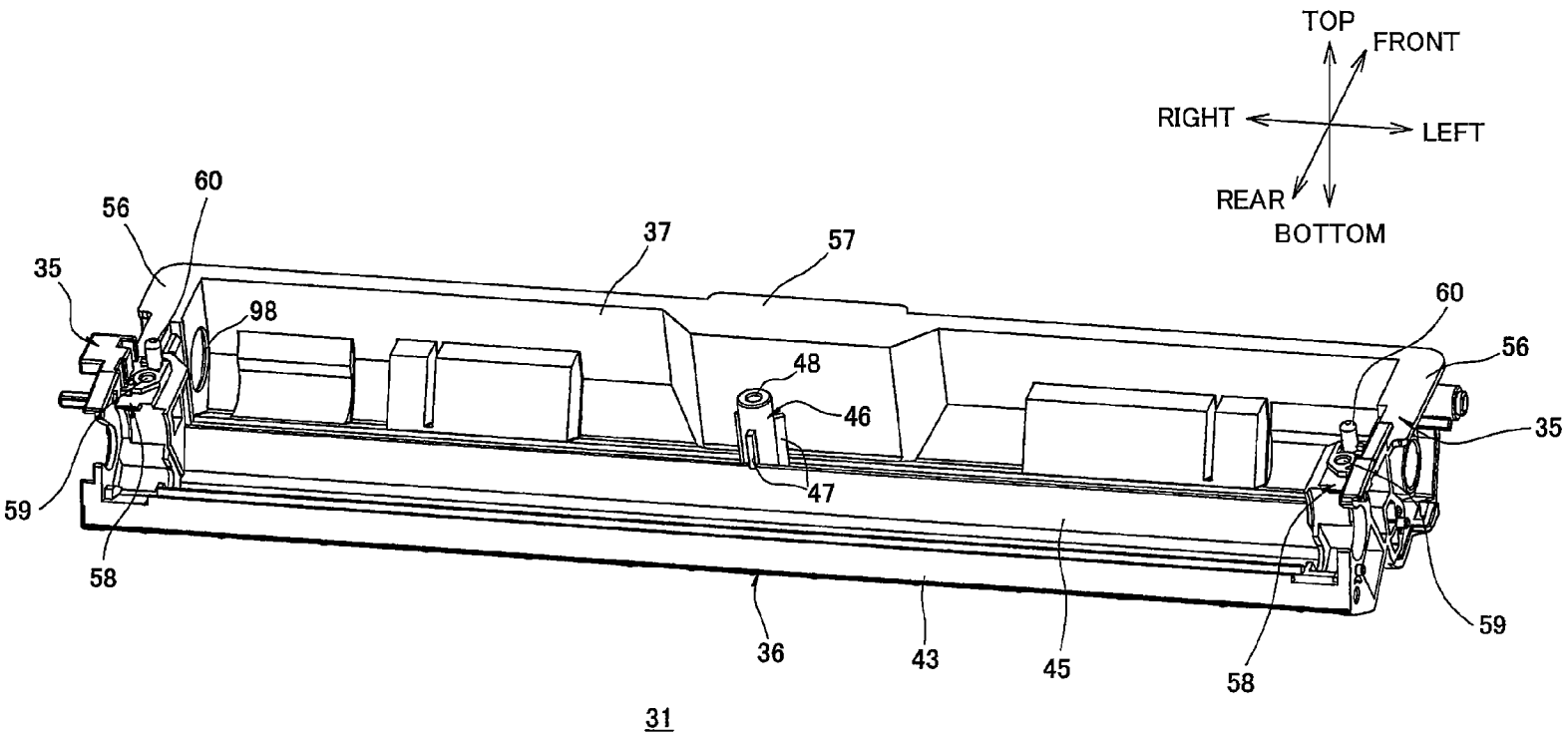
FIG. 6 is a perspective view of a developer cartridge having a single first fixing part according to a variation of the present invention when viewed from a left-top side.

For example, while the lower frame 31 described above is provided with a plurality (two in the embodiment) of first fixing parts 46, the lower frame 31 may be configured with a single first fixing part 46 disposed in the left-to-right center region of the lower frame 31, as illustrated in FIG. 6.

In this variation, only one of the through-hole 61, first fixing hole 89, elastic member 67, and notched part 65 of the agitating blade 64 need be provided for the first fixing part 46. This construction can help reduce manufacturing costs while achieving the operational advantages described above.

What is claimed is:

1. A developing device comprising:

a first frame comprising:

a pair of first walls opposed with each other; and a second wall connecting the pair of first walls and having a first fixing part;

a second frame comprising a third wall opposed to the second wall and attached to the pair of first walls when assembled to the first frame;

a developer-carrying member having an axis extending in a first direction, configured to rotate about the axis, and disposed between the pair of first walls; and a thickness-regulating member fixed to the first fixing part and configured to regulate a thickness of developer carried on the developer-carrying member, the third wall being disposed between the second wall and the thickness-regulating member, wherein each of the pair of first walls has a second fixing part to which the thickness-regulating member is fixed.

2. The developing device according to claim 1, wherein the third wall has a through-hole through which the first fixing part extends from the second wall to the thickness-regulating member.

3. The developing device according to claim 2, wherein the first fixing part is fitted in the through-hole with play.

4. The developing device according to claim 2, further comprising a plurality of first fixing parts symmetrically-formed on the second wall about a virtual plane passing at a center between the pair of first walls and orthogonal to the first direction, wherein the first fixing part is one of the plurality of first fixing parts.

5. The developing device according to claim 1, further comprising a sealing member disposed between the third wall and the thickness-regulating member to seal a gap between the third wall and the thickness-regulating member.

6. The developing device according to claim 5, wherein the first fixing part protrudes beyond the third wall a distance equal to or more than a thickness of the sealing member.

7. The developing device according to claim 5, wherein the thickness-regulating member comprises:

a first plate-like member extending in a second direction toward the developer carrying member and having a first end and a second end in the second direction, and having a contact part provided on the first end to regulate a thickness of developer carried on the developer-carrying member; and a second plate-like member provided to sandwich the second end of the first plate-like member and the sealing member in cooperation with the third wall.

8. The developing device according to claim 7, wherein the second plate-like member is fixed to the first fixing part.

9. The developing device according to claim 1, wherein each of the pair of first walls has a pair of positioning protrusion protruding toward the thickness-regulating member, wherein the thickness-regulating member has a pair of positioning holes into which the pair of positioning protrusions is inserted, respectively, to position the thickness-regulating member, and wherein the pair of positioning protrusions and the first fixing part are arranged in the first direction.

10. The developing device according to claim 1, further comprising an elastic member, wherein the first fixing part has a ridge part, the elastic member being provided between the ridge part and the third wall.

11. The developing device according to claim 1, wherein the first frame further comprises:

a partitioning wall partitioning the space into a developer-accommodating chamber for accommodating the developer; and a developing chamber in which the developer-carrying member is provided, wherein the first fixing part and the partitioning wall are arranged in a direction perpendicular to the first direction adjacent to each other.

12. The developing device according to claim 11, wherein the first fixing part extends in the developer-accommodating chamber.

13. The developing device according to claim 11, further comprising an agitator provided in the developer-accommodating chamber, the agitator comprising:

a rotational shaft rotatably supported by the pair of first walls; and an agitating blade supported by the rotational shaft and having a notched part to avoid contact with the first fixing part when the rotational shaft is rotated.

14. A developing device comprising:

a first frame comprising:

a pair of first walls opposed with each other; and a second wall connecting the pair of first walls and having a first fixing part, a second frame comprising a third wall opposed to the second wall and attached to the pair of first walls when assembled to the first frame;

a developer-carrying member having an axis extending in a first direction, configured to rotate about the axis, and disposed between the pair of first walls; and a thickness-regulating member fixed to the first fixing part and configured to regulate a thickness of developer carried on the developer-carrying member, wherein each of the pair of first walls has a second fixing part to which the thickness-regulating member is fixed.

15. The developing device according to claim 14, wherein the third wall has a through-hole through which the first fixing part extends from the second wall to the thickness-regulating member.

16. The developing device according to claim 15, wherein the first fixing part is fitted in the through-hole with play.

17. A developing device comprising:

a first frame comprising:

a pair of first walls separated from each other in a first direction; and a second wall connecting the pair of first walls and having a first fixing part, the first fixing part being separated from each of the pair of first walls;

a second frame comprising a third wall separated from the second wall in a second direction perpendicular to the first direction;

a developer-carrying member having an axis extending in a first direction, configured to rotate about the axis, and disposed between the pair of first walls; and a thickness-regulating member fixed to the first fixing part and configured to regulate a thickness of developer carried on the developer-carrying member, wherein the third wall is disposed between the second wall and the thickness-regulating member in the second direction, and wherein each of the pair of first walls has a second fixing part to which the thickness-regulating member is fixed.

18. The developing device according to claim 17, wherein the third wall has a through-hole through which the first fixing part extends from the second wall to the thickness-regulating member.

19. The developing device according to claim 18, wherein the first fixing part is fitted in the through-hole with play.

* * * * *